United States Patent [19]

Thany

[11] 4,036,424

[45] July 19, 1977

[54] HANDLE DEVICE

[75] Inventor: Imre Thany, New York, N.Y.

[73] Assignee: The Raymond Lee Organization, Inc., New York, N.Y. ; a part interest

[21] Appl. No.: 650,161

[22] Filed: Jan. 19, 1976

[51] Int. Cl.[2] ..... B65D 5/46

[52] U.S. Cl. ..... 229/52 A; 206/163; 294/93

[58] Field of Search ..... 294/93; 224/45 AB, 45 BA, 224/45 AC, 45 H, 45 P, 45 T, 75 W; 229/52 R, 52 A, 52 AC, 52 AW, 52 BC; 206/162, 163; 220/278; 16/125, 114 B; 24/30.5 R; 150/12; 5/345 B

[56] References Cited

U.S. PATENT DOCUMENTS

| | | | |
|---|---|---|---|
| 3,245,579 | 4/1966 | Tolaas | 206/163 |
| 3,608,814 | 9/1971 | Lautin | 229/52 A |
| 3,773,249 | 11/1973 | Hidding | 229/52 A |

*Primary Examiner*—James B. Marbert
*Attorney, Agent, or Firm*—Daniel Jay Tick

[57] ABSTRACT

A handle member has a handle. A grapple device is affixed to the handle for grappling an inside surface of a container. The grapple device comprises elastic wire having hook ends. The handle has a leg to which the elastic wire is affixed. When the leg is pushed through cardboard of a box the wire is flattened to the leg, and after the leg has penetrated the cardboard, the wire extends from the leg due to its elasticity. When the handle is pulled, the hooks catch the inside surface of the cardboard.

9 Claims, 8 Drawing Figures

HANDLE DEVICE

BACKGROUND OF THE INVENTION

The present invention relates to a handle device. More particularly, the invention relates to a handle device for carrying a container, box package, or the like.

Objects of the invention are to provide a handle device for a container, puncturable box, or the like, such as, for example, a paper or cardboard box, or the like, which handle device is of simple structure, inexpensive in manufacture, stored in a minimum space with facility and convenience, installed with facility, convenience and rapidity on a puncturable box and is instantly ready for use, and functions, efficiently, effectively and reliably to provide a sturdy and reliable handle for a box of paper or cardboard, or the like.

The handle device of the invention is instantly usable, and eliminates the need for first binding a container, package, or the like, with cord.

BRIEF SUMMARY OF THE INVENTION

Briefly, the aforementioned and other objects of the invention are satisfied by providing handgrips in any form with hooks attached. The handgrip may comprise a handle member having one or two legs. The handgrip may comprise a rigid disc having an axial bore formed therethrough and a strap affixed to the disc via the bore. The disc may have one or two legs extending therefrom.

Each leg has a piece of elastic, flexible, thin wire with hook ends affixed thereto. Each leg is small enough and sharp enough to push into a cardboard box by the thumb. When the handle or strap is pulled, the hooks, of which there are four, catch the package or box from the inside, ready to lift the package. Shoulder straps may be provided.

Two hooks are provided on one piece of elastic wire, or four hooks are provided on two pieces of elastic wire for each leg. In order to penetrate the cardboard, or the like, the legs must be very sharp, like nails, at their ends, and the wire must be flexible and thin.

When a rigid handle with one leg is used, a disc is preferably coaxially affixed to the leg to prevent deep penetration into the box, or the like. The disc is unnecessary when the strap handle is used, since the disc to which it is affixed prevents deep penetration in the container, or the like.

The basic idea of the invention is as follows. An elastic wire or band with hook ends is affixed to the bottom of a leg. The characteristic of the elastic, thin wire is that it flattens to the leg when pushed through cardboard, or the like, and stretches out again by its elasticity after penetrating the cardboard, or the like, and then catches the inside surface of the cardboard with its hooks when the handgrip is pulled. This principle is always the same. It is the whole meaning of the invention, even if the form of the handgrip varies.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
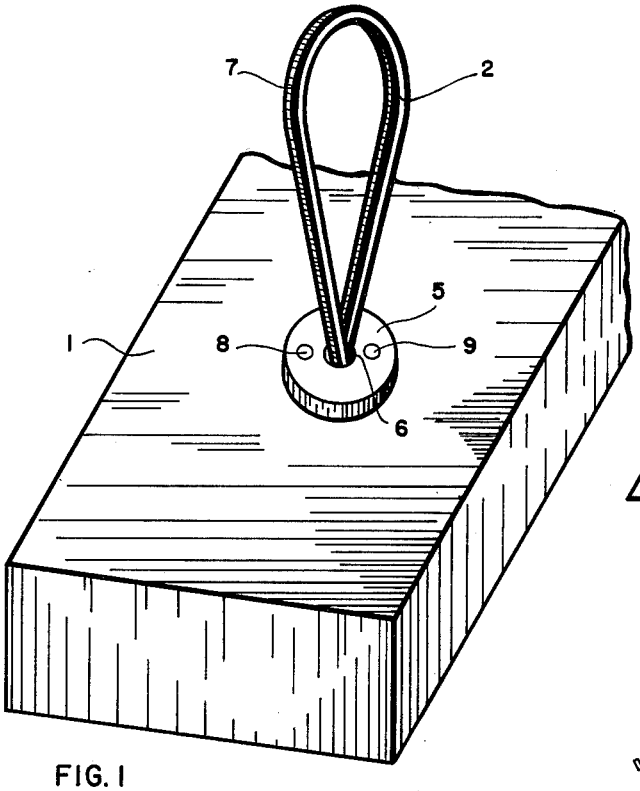
FIG. 1 is a perspective view of an embodiment of the handle device of the invention in use.
Figure 2:
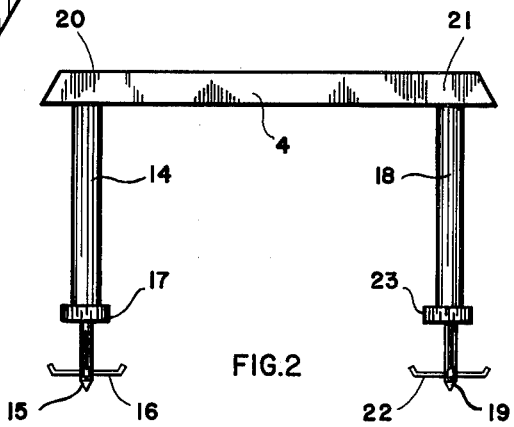
FIG. 2 is a side view, on an enlarged scale, of another embodiment of the handle device of the invention in position for puncturing a box.
Figure 5:
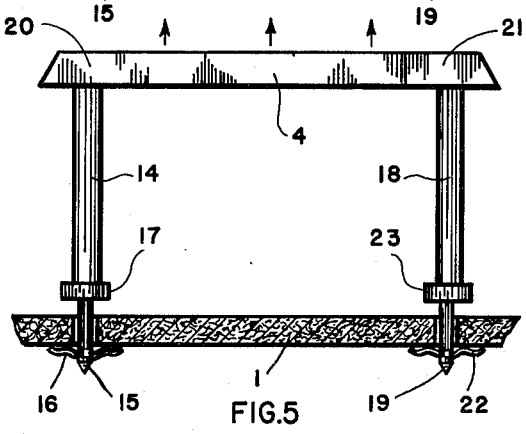
FIG. 5 is a side view, on an enlarged scale, of the handle device of FIGS. 2 and 3 in position for holding a box.

The handle device of the invention is for a puncturable container, package, box, or the like, 1 of paper, cardboard, or the like, and comprises a handle member 2 (FIGS. 1, 6 and 7), 3 (FIG. 8) or 4 (FIGS. 2 and 5).

Figure 6:
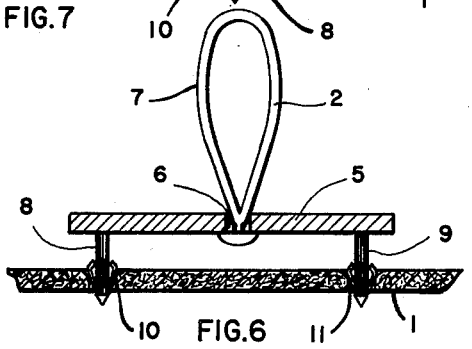
FIG. 6 is a side view, on an enlarged scale, of the embodiment of FIG. 1 puncturing a wall of a box.

In the embodiment of FIGS. 1 and 6, the handle member 2 comprises a substantially rigid disc 5 having an axial bore 6 formed therethrough and a strap 7 affixed to said disc via said bore.

First and second legs or posts 8 and 9, respectively, extend from the disc 5 (FIGS. 1 and 6) and have elastic wire or grapple members 10 and 11, respectively, affixed thereto. The elastic wire has hooked ends, as shown in FIG. 6.

Figure 7:
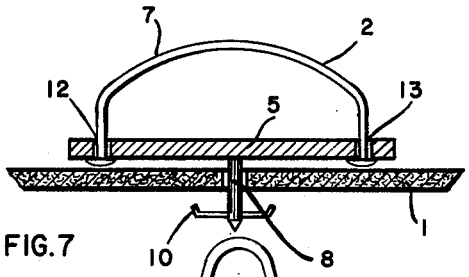
FIG. 7 is a side view, on an enlarged scale, of still another embodiment of the handle device of the invention.
Figure 4:
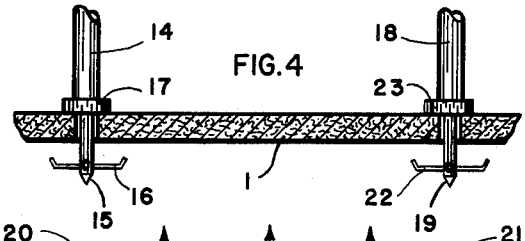
FIG. 4 is a side view of the handle device of FIGS. 2 and 3 after it has punctured a wall of a box.

In the embodiment of FIG. 7, the disc 5 has two spaced bores 12 and 13 formed therethrough and the strap 7 is affixed to said disc via said bores. A single leg or post 8 extends from the disc 5 (FIG. 7) and has elastic wire or grapple member 10 affixed thereto. The elastic wire has hooked ends, as shown in FIG. 7.

Figure 8:
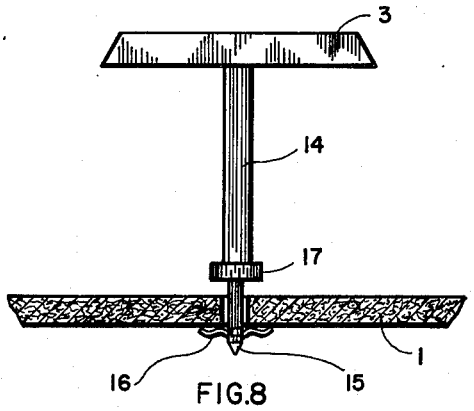
FIG. 8 is a side view, on an enlarged scale, of yet another embodiment of the handle device of the invention.

In the embodiment of FIG. 8, a single leg or post member 14 extends substantially perpendicularly from the handle member 3 and has a pointed free end 15 for piercing of the puncturable container, box, or the like, 1.

An elastic wire or substantially resilient grapple member 16 is affixed to the leg 14 and extends crosswise substantially perpendicularly from said leg in the area of the free end thereof for preventing said leg from being removed from the box 1 after it has penetrated said box.

A disc 17 is coaxially affixed to the leg 14 for restricting penetration thereof into the container 1.

In the embodiment of FIGS. 2 to 5, a second leg or post member 18 extends substantially perpendicularly from the handle member 4 and has a pointed free end 19 (FIGS. 2 to 5) for piercing the wall of the puncturable container, box, or the like, 1. In the embodiment of FIGS. 2 to 5, the first leg 14 extends from a first end 20 of the handle member 4 and the leg 18 extends from the second end 21 of said handle member (FIGS. 2 and 5).

A second elastic wire or substantially resilient grapple member 22 (FIGS. 2 to 5) is affixed to the leg 18 and extends substantially perpendicularly from said leg in the area of the free end thereof for preventing said second leg from being removed from the box 1 after it has penetrated said box.

A disc 23 is coaxially affixed to the leg 18 for restricting penetration thereof into the container 1.

Figure 3:
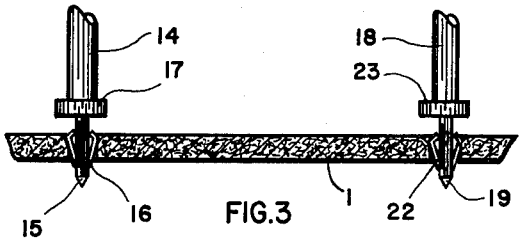
FIG. 3 is a side view, on an enlarged scale, of part of the embodiment of FIG. 2 puncturing a wall of a box.

The first and second elastic wires or grapple members 16 and 22 are pressed against the corresponding legs 14 and 18, respectively, during passage of the areas of the free ends of said post through the wall of the box 1, as shown in FIG. 3.

The elastic wires or grapple members 16 and 22 then extend, due to their resiliency, substantially perpendicularly from the legs 14 and 18, respectively, when the free ends of said legs are free from the box 1. This is the case before the handle device is installed in the box, as shown in FIG. 1, and after the handle device has been installed in the box, as shown in FIGS. 4, 5, 7 and 8.

When the handle device of the invention is in its operative position, as shown in FIGS. 5 and 8, the elastic wires or grapple members abut the inside surfaces of the wall of the container 1 and prevent the legs 14 and 18 from being removed from the container after penetration. The handle device is thus affixed to the box with strength and sturdiness and securely holds a box and contents of any reasonable weight.

The discs 17 and 23 are substantially coaxially affixed to the legs 14 and 18, respectively, at a distance from the pointed free ends thereof.

The discs 17 and 23 prevent deep penetration into the box. Since the disc prevents the further penetration of the post into the box, the position of said disc determines the extent of said penetration.

While the invention has been described by means of specific examples and in specific embodiments, I do not wish to be limited thereto, for obvious modifications will occur to those skilled in the art without departing from the split and scope of the invention.

I claim:

1. A handle device, comprising handle means, said handle means including a leg; and grapple means affixed to the handle means for grappling an inside surface of a puncturable container, said grapple means comprising resilient wire affixed to the leg of the handle means and having ends, said wire flattening to the leg when the leg is forced to penetrate into a container and stretching out due to its resiliency after penetrating the container and catching the inside surface of the container with its ends when the handle is pulled.

2. A handle device as claimed in claim 1, wherein the handle means comprises a hand bar, and wherein said leg extends from said hand bar.

3. A handle device as claimed in claim 1, wherein the handle means comprises a hand bar and a second leg, and wherein both legs extend from said hand bar, and the grapple means comprises a pair of resilient wires affixed to the legs of the handle means and having ends, each of said wires flattening to the corresponding leg when the leg is forced to penetrate into a container and stretching out due to its resiliency after penetrating the container and catching the inside surface of the container with its ends when the handle is pulled.

4. A handle device as claimed in claim 1, wherein the wire of the grapple means has hooked ends.

5. A handle device as claimed in claim 1, wherein the handle means further comprises a substantially rigid disc having an axial bore formed therethrough and a strap affixed to said disc via said bore, said disc being coaxially affixed to the leg for restricting penetration thereof into the container.

6. A handle device as claimed in claim 3, further comprising a pair of disc each coaxially affixed to a corresponding one of the legs for restricting penetration thereof into a container.

7. A handle device as claimed in claim 1, wherein the grapple means comprises a resilient band affixed to the leg of the handle means and forming a substantial V with the leg bisecting the V.

8. A handle device as claimed in claim 3, wherein the handle means further comprises a substantially rigid disc having an axial bore formed therethrough and a strap affixed to said disc via said bore, said disc being coaxially affixed to both legs with the pair of spaced legs extending from the disc in spaced parallel relation.

9. A handle device as claimed in claim 1, wherein the grapple means comprises a pair of resilient wires affixed to the leg and extending crosswise substantially perpendicularly from said leg.

* * * * *